US010926839B2

(12) United States Patent
Rivers

(10) Patent No.: US 10,926,839 B2
(45) Date of Patent: Feb. 23, 2021

(54) PORTABLE WATERCRAFT

(71) Applicant: Paul M Rivers, Jackson, WY (US)

(72) Inventor: Paul M Rivers, Jackson, WY (US)

( * ) Notice: Subject to any disclaimer, the term of this patent is extended or adjusted under 35 U.S.C. 154(b) by 0 days.

(21) Appl. No.: 16/865,325

(22) Filed: May 2, 2020

(65) Prior Publication Data

US 2020/0346716 A1 Nov. 5, 2020

Related U.S. Application Data

(60) Provisional application No. 62/843,430, filed on May 4, 2019.

(51) Int. Cl.

| | |
|---|---|
| ***B63B 1/12*** | (2006.01) |
| ***B63B 7/04*** | (2020.01) |
| ***B63B 5/00*** | (2006.01) |

(52) U.S. Cl.

CPC ..... *B63B 7/04* (2013.01); *B63B 1/125* (2013.01); *B63B 5/00* (2013.01); *B63B 2001/126* (2013.01)

(58) Field of Classification Search

CPC ..... B63B 2007/003; B63B 2007/006; B63B 7/02; B63B 7/04; B63B 7/06; B63B 7/08; B63B 7/082; B63B 2007/065; B63B 43/23; B63B 1/105; B63B 35/34; B63B 35/36; B63B 35/38

See application file for complete search history.

(56) References Cited

U.S. PATENT DOCUMENTS

| | | | | |
|---|---|---|---|---|
| 2,347,959 | A | 5/1944 | Moore et al. | |
| 2,495,190 | A | 1/1950 | Stewart | |
| 2,990,804 | A | 7/1961 | Garehime | |
| 3,316,873 | A * | 5/1967 | Dismukes | B63H 9/10 114/39.24 |
| 4,315,475 | A * | 2/1982 | Echols | B63B 7/02 114/61.24 |
| 5,316,508 | A | 5/1994 | Landucci | |
| 5,349,918 | A | 9/1994 | Elie | |
| 5,582,126 | A | 12/1996 | Rypinski | |
| 5,878,688 | A | 3/1999 | Merrett et al. | |
| 6,311,632 | B1 | 11/2001 | Noel | |
| 6,925,956 | B2 | 8/2005 | Rocha | |
| 7,314,014 | B2 * | 1/2008 | Heyring | B63B 1/14 114/61.15 |
| 7,461,607 | B2 | 12/2008 | Reilly et al. | |
| 7,587,986 | B2 | 9/2009 | Neidert et al. | |
| 9,254,895 | B2 | 2/2016 | Choi | |

* cited by examiner

*Primary Examiner* — Andrew Polay

(74) *Attorney, Agent, or Firm* — Hathway and Kunz PC; Thomas J. Siepmann

(57) ABSTRACT

An easily assembled highly portable watercraft comprising a modular boat system that seats one or more operators and is comprised of four or more pontoons connected to downward-sloping diagonally-placed outrigger beams with attached stiffeners connecting to a bridge-deck. The portable watercraft can be rowed, poled, propelled by fins or propellers, and sailed, for example, by an operator situated on the bridge-deck. The pontoons, outriggers, bridge-deck, and other aspects are easily interchangeable to conform to numerous configurations making a custom watercraft that is tailorable to varying water conditions.

18 Claims, 3 Drawing Sheets

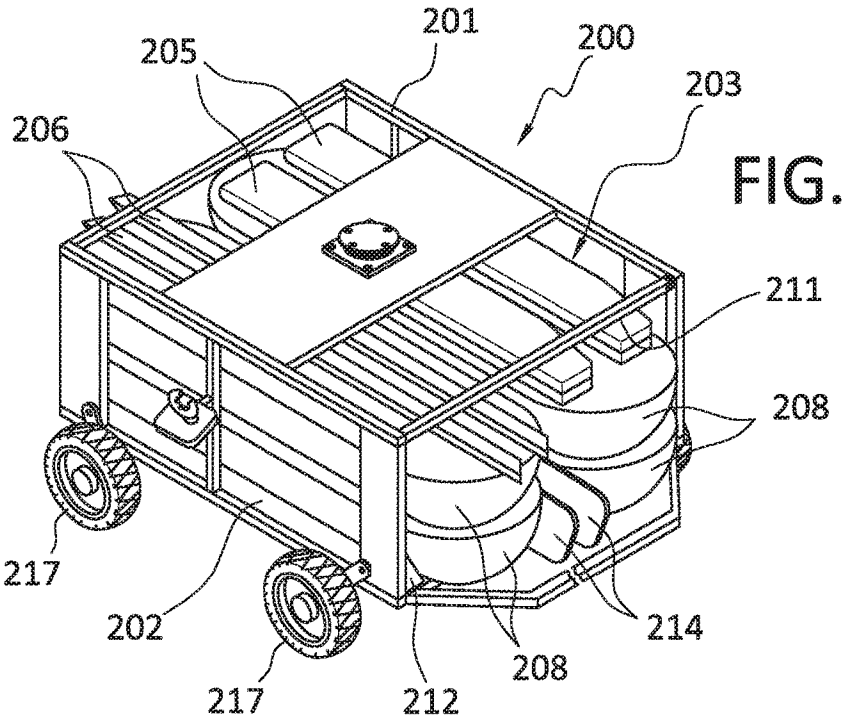
FIG. 2
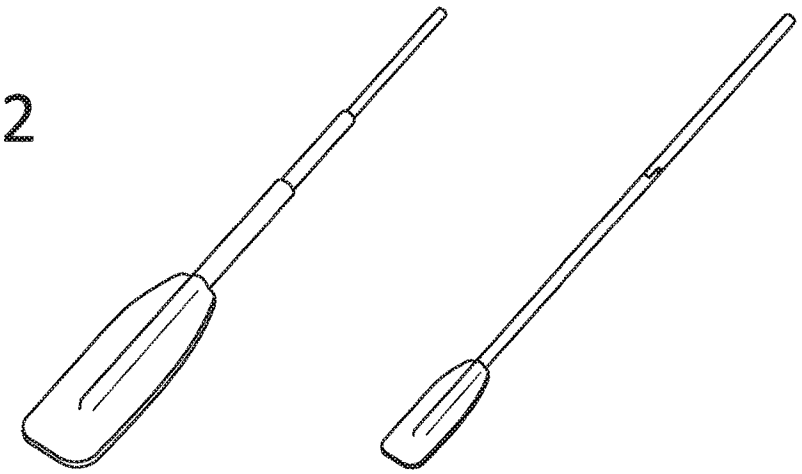
FIG. 5A
FIG. 5B
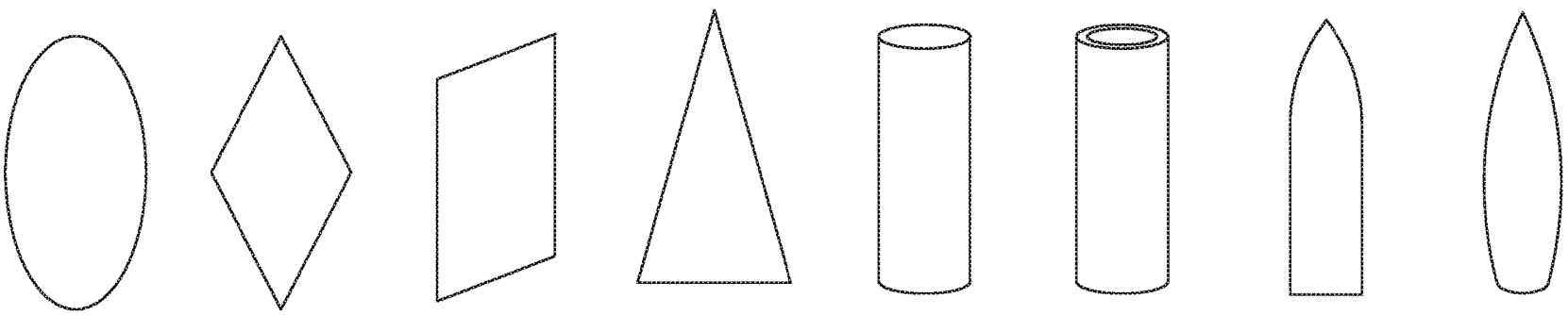
FIG. 4A FIG. 4B FIG. 4C FIG. 4D FIG. 4E FIG. 4F FIG. 4G FIG. 4H

PORTABLE WATERCRAFT

CROSS-REFERENCE TO RELATED APPLICATIONS

This patent application claims the benefit of U.S. Provisional Patent Application Ser. No. 62/843,430, filed May 4, 2019, the entire contents of which are incorporated herein by reference.

BACKGROUND

There is a long history of boats and watercraft dating back to 8000 years BCE. Watercraft for conveying humans exist in a myriad shapes, sizes, colors, and configurations. Even personal watercraft for conveyance of one or a few human passengers comprise a category with countless types. Even simple single-person floatation devices exist, such as the floating seat type watercraft described in U.S. Pat. Nos. 7,587,986, 6,925,956, 5,878,688, and 4,315,475. There is a category of bicycle boats or water bikes for single or multiple occupancy that include flotation elements along with bicycle handles, bicycle seats, gears, pedals, and connected paddles that allow an operator to skim across the water utilizing bicycle machinery. (See, for instance U.S. Pat. Nos. 9,254,895, 5,316,508, and 2,990,804). More complex personal watercraft abound, such as found in U.S. Pat. No. 5,582,126, which provides modularity of design, providing ability to utilize large and small hulls with connectors for manual assembly designed to be lightweight and portable.

Despite these myriad varieties of design and implementation, none of the boat designs available today are able to specifically fit all of the needs of the modern sportsman, outdoorsman, and/or fisherman. Today's sportsmen seek watercraft with customizable designs, that are adaptable to multiple environments, stable in different types of water environments, that accommodate one or more operators, and that are simple, easy to assemble and disassemble, lightweight, and portable. Thus, there remains a need for more modular, customizable, portable, and stable watercraft designed to be customized to fit the modern sportsmen's needs.

Provided herein are described watercraft that are highly portable, easy to assemble and disassemble, endlessly customizable, and able to meet the needs of sportsmen of numerous fields due to the modular nature of the boat system described herein. No other commercially available or previously described boats or watercraft are able to meet so many different requirements of today's water enthusiasts like the boat system described herein. And yet, this system is simple, composed of four or five basic core components including a bridge deck, four or more outriggers connected thereto, four or more floatation devices connected to the outriggers, and two or more outrigger stabilizers for added rigidity. These core components provide sufficient functionality to meet the modern needs of human beings working, recreating, hunting, exercising, and living in and around water.

SUMMARY

Provided is a modular, portable, easily assembled and disassembled, customizable watercraft or boat system. The modular boat system is comprised of: (i) at least four pontoons each comprising a top side and a hull or bottom side, (ii) at least four outriggers, wherein each outrigger is reversibly attachable to the top side each of the at least four pontoons, (iii) a bridge that is reversibly attachable to each of the at least four outriggers and comprises a compartment and a deck, wherein the deck is at least 2 foot by 4 foot in size, wherein the deck is on a bottom side of the bridge and the compartment is above the deck, (iv) at least two outrigger stiffeners, wherein each outrigger stiffener is attached at one to at least one outrigger, with an opposite end of each outrigger stiffener attached either to the bridge or to the opposing outrigger, or to another outrigger stiffener, and wherein each outrigger stiffener is optionally collapsible.

The described watercraft bridge has an open structure allowing storage of all other components of the modular system inside the bridge compartment for easy transportation and portability.

Thus, the described modular boat system has two forms—a fully assembled form and a fully unassembled form. When the modular boat system is assembled, each of the at least four pontoons are attached to and positioned below the at least four outriggers that extend diagonally downward from the bridge to each of the at least four pontoons. Further, when assembled, the bridge is attached to the at least four outriggers such that the bridge is above the at least four outriggers and above the at least four pontoons with the deck being on bottom of the bridge when the modular boat is placed on water. In such a form, an operator stands or is seated on the deck, inside the bridge compartment. In the assembled form of the described modular watercraft, the at least two outrigger stiffeners are attached to the at least two outriggers and extend from fore to aft of the bridge, thereby providing stabilization of the at least two outriggers. In a further embodiment of this form of the described watercraft, the modular boat system is capable of being rowed by an operator positioned on the deck of the bridge.

In another embodiment of the described modular watercraft, the boat is disassembled and packaged largely inside of the compartment of the bridge. Thus, when the modular boat system is disassembled the at least four pontoons, at least four outriggers, and at least two outrigger stiffeners, along with other optional components such as oars, seats, straps, etc., fit within the compartment inside the bridge. Thus, in one embodiment, all of the modular boat system components also fit within the compartment of the bridge.

The modular boat system described herein is portable. That is, the boat system, when disassembled, comprises a mass that is easily carried, rolled, dragged, or otherwise moved by a single operator or one or more operators. In one embodiment, to facilitate movement of the collapsed and disassembled modular boat, the watercraft is equipped with one or more wheels that are attached to the underside of the bridge, under the deck, or on the sides of the bridge, beside or equal level with the deck, such that when the modular boat system is disassembled and the various parts or components stowed into the compartment, then the modular boat system is conveyable on the one or more wheels along a ground surface by one or more operators pushing or pulling the collapsed and disassembled modular watercraft.

In one embodiment, the described boat system has overall dimensions, including all outriggers and pontoons, of no more than 10 foot by 16 foot, or 8 foot by 12 foot, or 6 foot by 8 foot. In one embodiment, the boat system is at least 10, 11, 12, 13, 14, 15, or at least 16 feet in length (fore to aft). In another embodiment, the modular boat system described herein is at least 5, 6, 7, or 8 feet in width (port to starboard). The deck of the described boat is of no particular shape or size but in one non-limiting example is generally rectangular in shape and is at least two foot by four foot in size.

The described portable watercraft, which is a modular boat system, comprises at least four pontoons or floatation devices, one of each of which are reversibly affixed to the ends of one of the four or more outriggers. In one embodiment, the modular boat includes a fifth pontoon reversibly attachable to the bridge via a reversible attachment to a further outrigger and/or attachable to a third outrigger stiffener spanning the gap between the front two pontoons. In another embodiment, the described boat system comprises at least a third outrigger stiffener that is reversibly attached to two pontoons, or their corresponding outrigger connections, at the front (fore) of the bridge.

The modular boat system described herein is conveyable on water in its assembled form in any number of possible configurations by any of many known means of water propulsion or conveyance by an operator situated on the bridge. In one embodiment, the modular boat system therefore includes a sail. The sail, in one embodiment, is operably attached to the fifth pontoon or attached to a third outrigger stiffener spanning the gap between the front (fore) two pontoons. The sail in certain embodiments comprises structural members including a horizontal bar and vertical bar with appropriate mechanical features used to furl and unfurl the sail by the operator while on water, for example. Optionally, the sail instead is attached to the third outrigger, and/or outrigger stiffener, that is reversibly attached to the two pontoons at the fore of the bridge, with the other end of the sail being attached to the bridge, for example.

Other optional propulsion systems of the modular watercraft include known propulsion systems such as, for example, oars, a motor, sail, and/or a pedal system optionally driving one or more fins and/or one or more propellers. Said propulsion system is in some embodiments reversibly attached to the bridge or part of the bridge.

Since the described modular boat system is highly portable, different portability elements are conceived herein that enable an operator to carry or otherwise transport the modular boat system. One such element includes one or more straps, for instance at least two backpack straps, that are reversibly fastened or affixed to the bridge. The backpack straps are optionally adjustable to accommodate differently sized operators or different modes of carrying the collapsed, disassembled boat.

Also contemplated herein is a modular boat system that further comprises one or more rudders that are reversibly attached to an underside surface of the bridge or deck by way of a rudder beam or other element attached to the bridge or deck. The rudder beam in such embodiments extends, when assembled, into the water with the rudder being in the water when the boat is assembled. The rudder beam therefore, in certain embodiments, extends to the topmost side of the bridge and comprises a handhold or other mechanically operable interface positioned on the deck that allows the operator to thereby steer the boat in the water as it is moving.

In another embodiment, the modular boat system described herein comprises at least two oars. Oars of various sizes, shapes, colors, and capacities are known in the art. For instance, in one embodiment, the at least two oars each comprise a paddle on one end and a handle on another end able to accommodate a human operator's hand. In some embodiments, the at least two oars lock into one or more oar attachment sites located on the bridge and/or on the outrigger stiffeners and/or outriggers such that the paddle is in water when the modular boat system is assembled and on water and the handle end extends to the topmost side of the bridge and is operable by an operator positioned on the deck. In such embodiments, the one or more oars are locked into the one or more oar attachment sites by a pin, oarlock, or by a bolt, or by a clip such is known in the art. In one particular embodiment, the oars are telescoping oars, collapsible oars, hinged oars, or are comprised of at least two pieces that assemble into a single oar, such that when not in use collapse to a small size able to be accommodated by the compartment within the bridge, or stowed away into the bridge, when not in use and/or when the modular boat system is disassembled for portability.

In another embodiment, the described bridge comprises one or more adapters into which the one or more outriggers are inserted when the modular boat system is assembled. Such adapters are known in the art and are selected for function based on the type of outrigger employed and the size of each outrigger. Generally, the adapters may in certain embodiments allow the outriggers to insert through the bridge from the outside of the bridge into the internal compartment within the bridge.

The pontoons or floatation members of the modular boat system are not particularly limited other than needing to be easily assembled and disassembled, i.e. reversibly attachable to the outriggers, and easily accommodated when disassembled into the bridge compartment for storage during transport. Thus, the four or more pontoons are in some embodiments in the shape of an oval, a diamond, a quadrilateral, a triangle, cylinder, a tube, a torpedo, or a surfboard, for instance.

In one embodiment, the described modular boat system comprises at least one seat reversibly attachable to the deck and/or the bridge, wherein the at least one seat is at least 15 inches wide. In some embodiments, the boat comprises two or more, or three or more such reversibly attachable seats.

In some embodiments, the materials from which the various components of the modular boat system described herein are selectable and interchangeable to suit the needs of the operator. Thus, in one embodiment, the at least four outriggers and/or at least two outrigger stiffeners are comprised of, for example, wood, metal, metal alloy, a composite material, carbon fiber, or a combination thereof. Likewise, in certain embodiments, the bridge is comprised of, for example, wood, metal, metal alloy, a composite material, carbon fiber, or a combination thereof. Additionally, in certain embodiments, the at least four pontoons are comprised of wood, metal, metal alloy, a composite material, carbon fiber, fabric, cloth, plastic, optionally injection molded plastic, or a combination thereof.

This Summary is provided to introduce a selection of concepts in a simplified form that are further described below in the Detailed Description. This Summary is not intended to identify critical or essential features of the claimed subject matter, nor is it intended to fully limit the scope of the claimed subject matter described more fully hereinbelow.

BRIEF DESCRIPTION OF THE DRAWINGS/FIGURES

For a more precise understanding of the disclosed portable watercraft, systems comprising the same, and methods of using the same, reference is made to specific embodiments thereof illustrated in the drawings. The drawings presented herein are not drawn to scale and any reference to dimensions in the drawings or the following description are with reference to specific embodiments. It will be clear to one of skill in the art that variations of these dimensions are possible while still maintaining full functionality for the intended purpose. Such variations are specifically contemplated and incorporated into this disclosure notwithstanding the specific embodiments set forth in the following drawings.

FIG. 1 is a view of the described boat 100 in assembled form. In this embodiment of the described modular boat system, the boat is equipped with an optional fifth pontoon, an optional third outrigger stiffener, optional sail(s), optional seat, and optional wheels and oars. Various cutouts are shown of the pontoons meaning that these elements may be made of various different materials. Likewise, broken elements indicate variability in length and size.

FIG. 2 provides a view of the described modular boat system in disassembled form, with components packed into the compartment 103.

FIG. 3 provides another view of the described modular boat system in assembled form. In this embodiment of the described modular boat system, the boat is equipped with two seats and depicts various optional propulsion systems such as motor, fins, and the like. Also depicted are different embodiments of outriggers 105 in which the outrigger is collapsible, telescoping, or comprises internal cutouts to allow air and water to pass therethrough.

FIGS. 4A through 4H depict various contemplated embodiments of pontoon 108 shapes.

FIG. 5A shows an optional oar 114 in an optional telescoping form.

FIG. 5B shows an optional oar 114 in an optional hinged form.

DETAILED DESCRIPTION

Definitions

Figure 1:
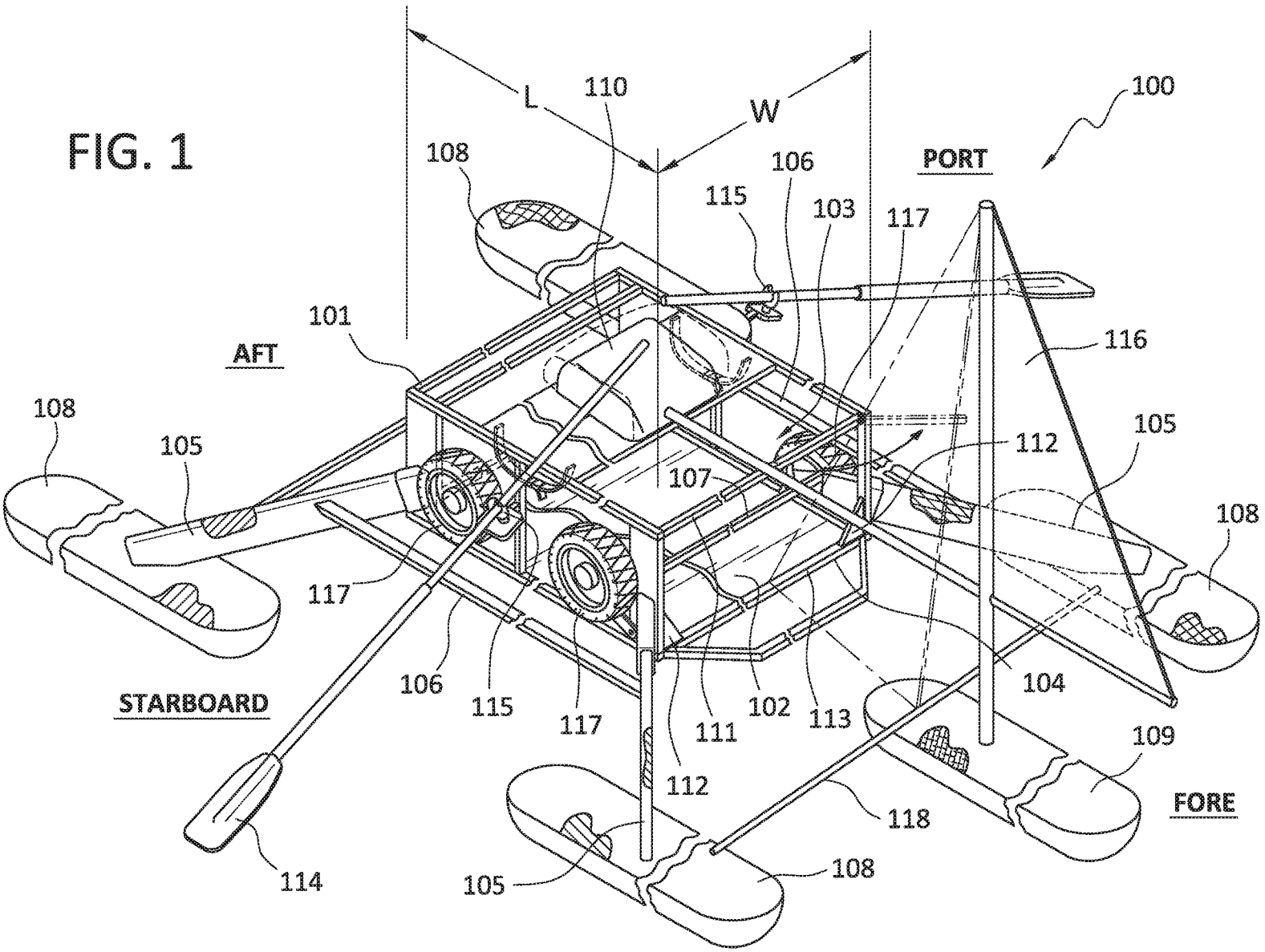

The term "a" or "an" entity as used herein refers to one or more of that entity; for example, "an oar," is understood to represent one or more oars. As such, the terms "a" (or "an"), "one or more," and "at least one" are herein used interchangeably herein.

Furthermore, "and/or" where used herein is to be taken as specific disclosure of each of the two specified features or components with or without the other. Thus, the term "and/or" as used in a phrase such as "A and/or B" herein is intended to include "A and B," "A or B," "A" (alone), and "B" (alone). Likewise, the term "and/or" as used in a phrase such as "A, B, and/or C" is intended to encompass each of the following embodiments: A, B, and C; A, B, or C; A or C; A or B; B or C; A and C; A and B; B and C; A (alone); B (alone); and C (alone).

As used herein, the term "about" or "approximately" refers to a variation of 10% from the indicated values (e.g., 50%, 45%, 40%, etc.), or in case of a range of values, means a 10% variation from both the lower and upper limits of such ranges. For instance, "about 50%" refers to a range of between 45% and 55%.

Unless defined otherwise, nautical and scientific terms used herein have the same meaning as commonly understood by one of ordinary skill in the art to which this disclosure is related.

Units, prefixes, and symbols are denoted in their Système International de Unites (SI) accepted form. Numeric ranges are inclusive of the numbers defining the range. The headings provided herein are not limitations of the various aspects or aspects of the disclosure, which can be had by reference to the specification as a whole. Accordingly, the terms defined immediately below are more fully defined by reference to the specification in its entirety.

As used herein, the term "fore" means front. For instance, the "fore" of a boat is the front of the boat, or the side of the boat facing the direction in which the boat is moving through the water. When an operator is seated or standing on the bridge or deck of the boat and facing in the direction of motion of the boat, the fore is in front of the operator, for example.

As used herein, the term "aft" means the rear or backside. For instance, the "aft" of a boat is the back side of the boat, or the side of the boat facing the opposite direction in which the boat is moving through the water. When an operator is seated or standing on the bridge or deck of the boat and facing in the direction of motion of the boat, the aft of the boat is behind the operator, for example.

The terms "watercraft" and "boat" are used interchangeably herein and generally mean a structure that floats on water and can accommodate at least one operator. These terms are generally defined in the claims and elsewhere throughout this description as comprising various modular and interchangeable components that are reversibly attachable to each other to form the watercraft or boat comprising various optional components as described hereinbelow.

The term "modular" as used herein means standard units of elements that are interchangeable. The modular components together when assembled form the described boat or watercraft. The term modular implies modular design theory wherein various individual components of a whole system are subdivided into individual parts that when attached together create the watercraft or boat. Each individual part or module, as described herein, is interchangeable with other like modules. For instance, a wooden outrigger module is interchangeable with a carbon fiber outrigger, aluminum outrigger, and the like. Each component of the described watercraft is a module itself. That is, the propulsion system is a module, outriggers are modules, pontoons or float devices are additional modules, all of which are interchangeable, separable from the whole, and substitutable with other variations of like modules.

The term "portable" as used herein means that one or more operators, for instance two operators, or at most three or four operators, are capable of lifting, moving, pushing, or otherwise conveying the item on land. Thus, the described watercraft is portable when disassembled possesses a size and weight that allows one or more operators to lift, move, position, carry, or otherwise convey the disassembled watercraft to an intended destination over land.

An "operator" as the term is referred to herein means a human However, in certain instances, the term "operator" is used herein more expansively to also include passengers. Thus, a seat present on the described watercraft is typically designed to accommodate a human of any age, size, or weight, but could also be a seat designed for a domesticated animal, pet, livestock, or other animal. Optionally, each seat further comprises a back to support the back of the operator when seated.

Modular Watercraft/Boat System

Provided herein is a modular boat system 100 that comprises a boat or watercraft capable of flotation on water while carrying or holding the weight of one or more operators positioned on the deck 102 or bridge 101 of the boat while sitting or standing. (FIG. 1).

The modular watercraft system described herein comprises at least the following core components: (i) a bridge 101 optionally including a deck 102, (ii) outriggers 105, (iii) pontoons or floatation devices 108, and (iv) outrigger stiffeners 106. Each of these core components and their interrelationships are described in further detail below.

Bridge

The presently disclosed modular boat system 100 begins with the core component of a bridge 101. (See, FIG. 1). The shape of the bridge of the modular watercraft described herein is not particularly constrained except that it is large enough to accommodate one or more operators. The bridge must also reversibly attach to at least four outriggers 105. While the outriggers 105 are contemplated herein to be attached to each corner of the bridge 101, i.e. off the port bow, starboard bow, starboard quarter, and port quarter, as depicted in FIG. 1, this is merely one embodiment, as described further below in the section concerning outriggers 105.

The bridge 101 is comprised of materials capable of supporting the weight of one or more humans without collapsing. The materials of the bridge are positioned such that this weight is supported. Non-limiting examples of such materials include, for instance, wood, alloy metals, metals, such as aluminum, composites, plastics, carbon fiber, bamboo, and combinations thereof.

Thus, the bridge 101 in some embodiments is a cage structure, forming the shape of a rectangular or other quadrilateral-shaped box having a bottom side 104, fore side, aft side, port side, and starboard side. In another embodiment, the structure is a cubed shape. In another embodiment, the bridge has curved or rounded edges and is shaped like an oval. In other embodiments, the bridge comprises full or partial solid sides such that water is prevented from entering the bridge. Alternatively, the sides of the bridge 101 are made of a netting material, cross-hatched material, fabric, rubber, ropes, or other physical barrier that acts to both prevent items from inside the bridge 101 from falling overboard and to provide stabilization and strength to the bridge 102 framework.

The bridge comprises a compartment 103 and optionally a deck 102. The compartment 103 is the space empty inside the bridge 101 into which the operator steps to gain access to the watercraft's seat 110, if present, and in which the operator(s) stand to maneuver or otherwise control the boat 100. Thus, an operator enters the boat, for instance, from the forward side, then stands on the deck 102 on the bottom side 104 of the bridge 101. The compartment 103 is defined by the bridge 101 framework. As shown in FIG. 1 the framework of the bridge 101 is a series of linear beams running lengthwise and widthwise and attached perpendicularly at right angles to form the shape of a box. The bottom side 104 of the bridge 101 also optionally comprises cross-members (not shown) just under the deck 103 provided for stability, support, and rigidity to the structure of the bridge.

The deck 102 is made of any type of material that supports the weight of one or more operators and any optional equipment present in the compartment 103 of the bridge 101. Thus, the deck 102 is a flat material, or floor, on which the operator(s) stand or kneel and that supports the contents of the bridge 101. The deck optionally is provided with a rubberized surface to prevent slippage of the operator when wet and is comprised multiple types of materials for reinforcement and stabilization of the overall bridge structure. The deck 102 optionally matches the outer dimensions of the bridge 101 such that the deck 102 covers the entirety of the bottom 104 of the bridge 101. In another embodiment, the deck 102 only covers a portion of the bottom 104 of the bridge 101. For instance, in one embodiment there are cut-outs in the deck 102 that allow water in the compartment 103 to escape or otherwise exit the compartment 103 or to provide for flow of air through the bridge compartment 103. In another embodiment the deck is comprised of a grate material with holes throughout the deck to allow passage of air and water therethrough in a honeycomb-like pattern. In such an embodiment the deck is likely comprised of alloy metal or other metals such as aluminum and the like. The size or dimensions of the deck 102 are not particularly limited except that in most embodiments the size of the deck 102 does not exceed the outermost dimensions of the bridge 101. For instance, in one embodiment, the deck 102 is approximately 2 foot by 4 foot in size (width×length). In other embodiments, the deck 102 is 10 foot by 16 foot, or 8 foot by 12 foot, or 6 foot by 8 foot in size (width×length).

The height of the bridge 101 from its deck 102 to the top of the bridge is not particularly limited, but in certain embodiments is not more than 2, 2.5, 3, or even 3.5 vertical feet in height. In some embodiments the bridge framework is open allowing air and water to pass therethrough to the operator and the compartment 103. In other embodiments, the bridge comprises solid sides made of mesh, or other cloth material, or a solid matter such as plastic, wood, aluminum, or other metal, carbon fiber, etc. In one embodiment of the described bridge, the sides are solid and are capable of being folded down and away from the operator, i.e. away from the compartment 103 thereby providing additional space for the operator to sit or stand with respect to the deck 102. By allowing the sides to reversibly fold down it is possible to thereby extend the number of square feet the deck 102 occupies, thereby allowing the occupant or operator in the compartment or seated on the seat more freedom of motion.

Optionally, in one embodiment, the bridge includes a forward horizontal bar at its top called a front beam 111. The front beam 111 acts functionally as a gate allowing access to the compartment 103. The front beam 111 is contemplated to be comprised of any number of known support materials such as wood, alloy metals, metals, such as aluminum, composites, plastics, carbon fiber, bamboo, and combinations thereof. At least one side of the front beam 111 is reversibly detachable from the remainder of the bridge 101. Upon detachment, the front beam 111, in one embodiment, swings horizontally forward and optionally fully 270 degrees around a pivot point which is in one embodiment the forward port or starboard upper corner of the bridge 101 frame. Thus, when unlatched, the front beam 111 pivots up to 270, 180, 90, or 45 degrees to allow the operator access onto the bridge 101 and deck 102. Upon entry, the operator then swings the front beam 111 back to reconnect its loose end with the opposite forward upper corner of the bridge 101 framework, thereby securing and stabilizing the bridge 101. The front beam 111 is secured to the bridge framework by known mechanisms such as hinges, bar locks, latches, magnetic connectors, flex grip and roller catches, elbow catches, slide/barrel bolts, magnetic catches, touch laches, ball tension and bullet catches, cabin hook and draw latches, and the like. In another embodiment, the front beam 111 comprises a middle hinge in addition to end attachments at each bridge 101 corner allowing the operator to unhinge or disconnect the two separate parts of the front beam 111 into two parts, each of which swing away from the bridge 101 or upwards from the bridge 101 to allow the operator to access the compartment 103 or deck 102. Alternatively, the front beam 111 sits in a cradle arrangement connected by the upper two forward corners of the bridge 101 framework. In this embodiment, the front beam 111 is capable of being lifted entirely away from the bridge 101 to allow the operator to access the compartment 103 and deck 102. Upon boarding, the front beam 111 is then replaced into its cradle to complete the bridge 101 framework.

The bridge 101 further comprises at least two bridge supports (or spanners) 112. In shipbuilding, such spanners or supports are often referred to as "knees" and can be alternatively referred to as "standing knees" or "hanging knees" or "lodging knees" or "bosom knees." Here, the term support is used interchangeably with the term "knees." Bridge supports 112 as shown in FIG. 1 are positioned forward on the boat 100 at the bottom 104 of the bridge 101 and occupy a space between the vertical forward bridge framework members and the bottom 104 or bottom horizontal forward beam 113. As depicted in FIG. 1 the bridge supports 112 are triangular in shape. In common shipbuilding terms these would be sometimes referred to as "standing knees." The bridge supports 112 are comprised of any type of rigid and supporting material such as, but not limited to, wood, alloy metals, metals, such as aluminum, composites, plastics, carbon fiber, bamboo, and combinations thereof. The function of the bridge supports 112 is to add rigidity and support to the forward bridge area and to avoid collapse of the bridge upon the boarding of the operator, for example. The size and shape of the bridge supports 112 are not particularly limited other than that they must be of sufficient size and shape to fully support the necessary weight capacity for which the boat 100 is designed to hold based on occupancy and cargo load, for instance. In one embodiment bridge supports 112 are also present on the aft two sides of the bridge 101 to provide additional support to the bridge 101 structure. In another embodiment, the bridge supports 112 are molded into and part of the same frame as the bridge and are not added onto the bridge frame during manufacturing but rather are part of the original frame as a single front piece of the bridge frame.

Outriggers

The modular boat system 100 core components further comprise at least four outriggers 105 reversibly attached to the bridge 101. The position of the outriggers is not particularly limited but in one particular embodiment one of each outrigger 105 is reversibly attached to the bridge 101 generally in the following four areas of the bridge 101: starboard bow, port bow, port quarter, and starboard quarter. The outriggers 105 generally point downward from the bridge 101 and slope diagonally downward as depicted in FIG. 1.

Each of the outriggers 105 connects to the bridge 101 and optionally extend internally into the compartment 103 of the bridge 101. In another embodiment, the outriggers 105 do not extend internally into the compartment 103. In one embodiment, in which the outriggers extend into the bridge compartment 103, the two forward outriggers 105 are connected internally within the compartment 103 by a stiffener 107. Likewise, the two aft outriggers 105 are connected internally within the compartment 103 by a spreader 107. The spreader 107 act to further stabilize the bridge 101 framework and structure thereby preventing collapse under heavy load, i.e. when board by one or more operators or when the boat 101 is carrying heavy cargo, etc. Together with bridge supports 112, spreader 107 create a solid, firm, and capable structure able to withstand external and internal pressures placed on the watercraft.

The outriggers 105 are reversibly attached to the bridge 101. The mechanism by which the outriggers attach either to the bridge 101 or the pontoons 108 is not particularly limited. In one embodiment, one end of each outrigger 105 inserts into an equivalently sized sleeve or port in the side of the bridge 101 and thereby locks into place by a pin, bolt, or clip mechanism known in the art for such purposes. The point at which each outrigger connects to the bridge, or bridge frame, is not particularly limited. In one embodiment, each outrigger connects to the bridge at the bottomside 104 of the bridge 101, in the middle of the bridge, or at a top side of the bridge. In general, each outrigger is attachable to an opposite corner of the bridge 101 as shown in FIG. 1. In all instances, each outrigger is downward-sloping from the viewpoint of a standing operator positioned on the deck and spreading out in a diagonal pattern away from the bridge.

Furthermore, the attachment of stiffeners 107 to the internal ends of the outriggers 105 inserted into the compartment 103 is by way of any of a number of known mechanisms including, for example, by way of commercially available latches, sleeves, lashings, spring-loaded pins, pole connectors, pins, clips, spring-loaded clips, threaded bolts, swivel connectors, or other such fastening mechanism known for securely fastening framework components together in a reversible manner Other connectors, such as adapters shaped to the ends of each component and comprised of a stiff material such as heavy plastic, carbon fiber, metal, and the like, are also contemplated. Such reversible attachment mechanisms are contemplated herein for all such attachments discussed herein and apply equally to all such securely and reversibly fastenable elements of the boat 100.

Outriggers 105 are comprised of various materials capable of supporting the weight of the bridge 101 and its contents as well as withstanding the structural pressures and forces imposed on the outriggers 105 by the pontoons 108, wind, and water current pressures, etc. For instance, outriggers are comprised of wood, metal, metal alloy, a composite material, carbon fiber, or a combination thereof.

Likewise, outriggers 105 may be of any shape including, for instance, generally linear shape, with or without tapered ends. In one embodiment, the outrigger 105 shape is that of a common 2×4 piece of wood, as depicted in FIG. 1. In another embodiment, the outrigger 105 is shaped as a pole, for instance a telescoping pole, or latched or hinged pole, that is capable of being broken down when not in use into multiple sections to be stowed away into the compartment 103. In another embodiment, the outriggers 105 are shaped as depicted in FIG. 1 and possess hollowed-out sections internally to allow water and air to pass therethrough. Outriggers 105 are of any length but generally are between about 3 foot and about 10 foot in length. In one embodiment the outriggers are at least 5, 6, 7, 8, 9, or 10 feet in length. In another embodiment, the outriggers are 3, 4, 5, or 6 foot in length.

Each outrigger 105 also comprises at one end opposite the end that attaches to the bridge 101 a functional component allowing reversible and secure attachment to a topside of a pontoon or flotation device. Various mechanisms of attachment of poles or outriggers 105 to pontoons 108 are known and are not here particularly limited so long as the attachment is secure, reversible, and able to withstand the pressures and forces imposed thereon during use by the weight of the bridge 101 and the water currents and wind, etc. Any of the above-mentioned reversible attachment mechanisms are contemplated herein for attachment of the pontoon 108 to the outrigger 105 end. For instance, in one non-limiting example, the outrigger end is insertable into a port or sleeve in the pontoon 108 of equal size and shape to match the outrigger 105. Commensurately, each outrigger in this embodiment possesses, for instance, a flashing along its circumference (not depicted) that stops insertion of the outrigger end into the pontoon at a secure position and depth.

Outrigger Stiffeners

In addition to the at least four outriggers 105 described above, also contemplated herein as structural components of the boat 100 are at least two outrigger stiffeners 106. Each of the outrigger stiffeners 106 are of any desired shape and are, in one embodiment, generally linear, curved, tapered, or otherwise angled. Each outrigger stiffener 106 lies generally parallel to the length of the bridge 101 and outside the bridge 101, reversibly attached at opposite ends to at least two outriggers 105 as shown in FIG. 1. In one embodiment, the watercraft includes at least two outrigger stiffeners 106 positioned more-or-less parallel to the length of the bridge 101 running fore to aft and on opposite sides of the bridge 101, port and starboard, to provide additional rigidity and strength support to the outriggers 105. Each outrigger stiffener 106 is reversibly and securely attached to at least two outriggers 105 by way of any of the reversible attachment mechanisms noted above or described elsewhere herein. For instance, in one embodiment, each end of each outrigger stiffener 106 possesses a sleeve (not shown) that fits securely over the outrigger 105 to which it is matched. The sleeve is optionally comprised of any rigid and impermeable material such as metal, plastic, composite, etc.

In an alternative embodiment, the watercraft comprises additional outrigger supports (not depicted) that brace or undergird the underside of each outrigger and are shaped roughly triangular and having a width similar to the outrigger width, or less, and positions at the junction of the outrigger and the bridge for additional support of the outrigger. As already mentioned above, in shipbuilding, such triangular-shaped supports are often referred to as "knees" and can be alternatively referred to as "standing knees" or "hanging knees" or "lodging knees" or "bosom knees." Such supports are similar in shape and function as the bridge supports 112 described above, except that in this embodiment they are placed at the juncture of the bridge and outrigger and form either an open or closed triangular shaped structure underneath the deck to provide additional rigidity to the outriggers as the watercraft moves through water. As such, in common shipbuilding terms, such outrigger supports may be termed "hanging knees." Such outrigger supports are also reversibly attachable to the outrigger, bridge, and/or deck as necessary for additional structural support of the watercraft.

Each outrigger stiffener 106 is optionally itself collapsible. That is, each outrigger stiffener 106 being of a length larger than the longest length of the bridge 101 in certain embodiments, is capable of being broken down into two components attached by hinge, elastic, spring-release bolt, or the like, to provide easy stowage of the outrigger stiffeners when not in use. In one embodiment, each outrigger stiffener 106 is telescoping and able to be reversibly and securely extended into a locked position and later collapsed into a reduced length for easy stowage.

Additional outrigger stiffeners 106 are added to the boat 100 in some embodiments where additional length of outrigger 105 and larger sized bridge 101 is desired. For instance, the boat 100 comprises in some embodiments as many as four, six, or even eight outrigger stiffeners 106. In some instances, the watercraft comprises at least four outrigger stiffeners with each outrigger stiffener 106 attached at one end of the stiffener to the outrigger and at the opposite end to the bridge, thereby forming a triangular arrangement between the bridge 101, outrigger 105, and outrigger stiffener 106 (not depicted) generally located under the bridge 101 and/or under the deck 102. In such embodiments there would be one outrigger stiffener 106 per outrigger. The outrigger stiffener 106 would be attached at one end anywhere along the length of the outrigger that provides support to the outrigger as in the above embodiments, but in such an embodiment the opposite end of the outrigger stiffener 106 would then attach to the bridge instead of attaching to another outrigger. The location of attachment of the outrigger stiffener 106 to the bridge in such embodiments is not particularly limited but could be anywhere between the middle and end of the bridge on the side of the outrigger to which the other end is attached, or even attached under the bridge deck 102. In various alternative embodiments, the bridge 101 and outriggers 105 are further supported by additional supports or knees, such as one hanging knee per outrigger, or even one hanging knee for each of the two or three front outriggers (not shown), as described above. Thus, in some embodiments, there can be as many as four or five outrigger stiffeners with or without additional supports or gussets as described above.

Pontoons/Floatation Devices

The term "pontoons" as used herein mean any of a number of variously sized and shaped floatation modules made of various material including, for instance, wood, metal, metal alloy, a composite material, carbon fiber, fabric, cloth, plastic, optionally injection molded plastic, or a combination thereof. The pontoons 108 are of any size and shape generally known to be capable of supporting the weight of one or more operators and other components described herein. In one embodiment, the pontoons are made of lightweight material and are of a size that fits securely inside the bridge 101 when not in use, as shown, for instance, in FIG. 2.

FIG. 4A through FIG. 4H provides various non-limiting embodiments of pontoon 108 shape, size, and thickness contemplated herein. For instance, in one embodiment, the pontoon 108 is shaped as a hull with flat top as in FIG. 1. In another embodiment, the pontoon is shaped as a surf-board with only a foot or less of thickness but broad surface area that supports the weight of the boat 100. In the later embodiment, the surf-board-shaped pontoons stack inside the bridge 101, one atop the other so as to allow easy portability thereof. Such pontoons 108 as mentioned above are made of lightweight material allowing easy of portability. In other embodiments, the pontoons 108 are shaped as an oval, a diamond, a quadrilateral, a triangle, cylinder, a tube, or a torpedo.

In some instances, when the pontoons 108 are disassembled and placed inside the bridge compartment 103, the ends of each pontoon 108 do not entirely fit inside the compartment 103 and aspects or edges or ends of one or more pontoons may protrude or extend beyond the framework of the bridge 101 due to their size.

In one embodiment, the pontoons 108 are inflatable and are in certain instances comprised of fabric, cloth, or plastic that holds air. In another embodiment, the pontoons 108 are comprised of a foam or other composite material that is highly buoyant and provided with a cover that provides resistance to salt, sunlight, and other environmental factors that tend degrade such materials over time.

Optionally one or more of the pontoons 108 comprise a foil or fin attached to their bottom such that when sitting in water they act to assist in maneuvering and directing the boat in a straight line.

Other Modular Components

The modular boat system 100, while comprising the main core components described above, additionally may comprise one or more optional components described hereinbelow. These optional components are add-ons that the operator may choose to select to customize the modular boat system to support a specific need, situation, or goal.

Optionally, the described modular boat system 100 further comprises one or more propulsion systems. One such contemplated propulsion system is a pair of oars 114. (FIG. 1). As shown in FIG. 5, the one or more oars 114 are in some embodiments telescoping to allow for extension and/or shortening as needed for use or storage, as the case may be. Alternatively, as also shown in FIG. 5, the oar comprises a hinge allowing folding of the oar in half or comprises multiple hinges allowing the operator to break the oar down into multiple parts for stowage when not in use. Numerous lengths, shapes, styles, sizes, and weights of oars are known and all are contemplated herein as being useful with the described modular boat 100. In some embodiments, the oars further comprise a handle or other grip at the bridge-side end of the oar for ease of use by the operator. Optionally, the paddle at the end of each oar is removable to provide for easier stowage. The modular boat optionally also comprises one or more oar locks 115 on the port and/or starboard sides of the boat 100 thereby allowing an operator positioned in the middle of the bridge 101 to propel the boat forward or backward by swinging the oars 114. The oar locks 115 are not particularly limited but include, for instance, D rings, C clamps, clamps, round rowlock horns, and the like known in the art. Oar locks 115 are optionally mounted securely onto the bridge 101 framework and/or secured by additional stiffeners extending to one or more outriggers 105 and/or outrigger stiffeners 106.

Figure 3:
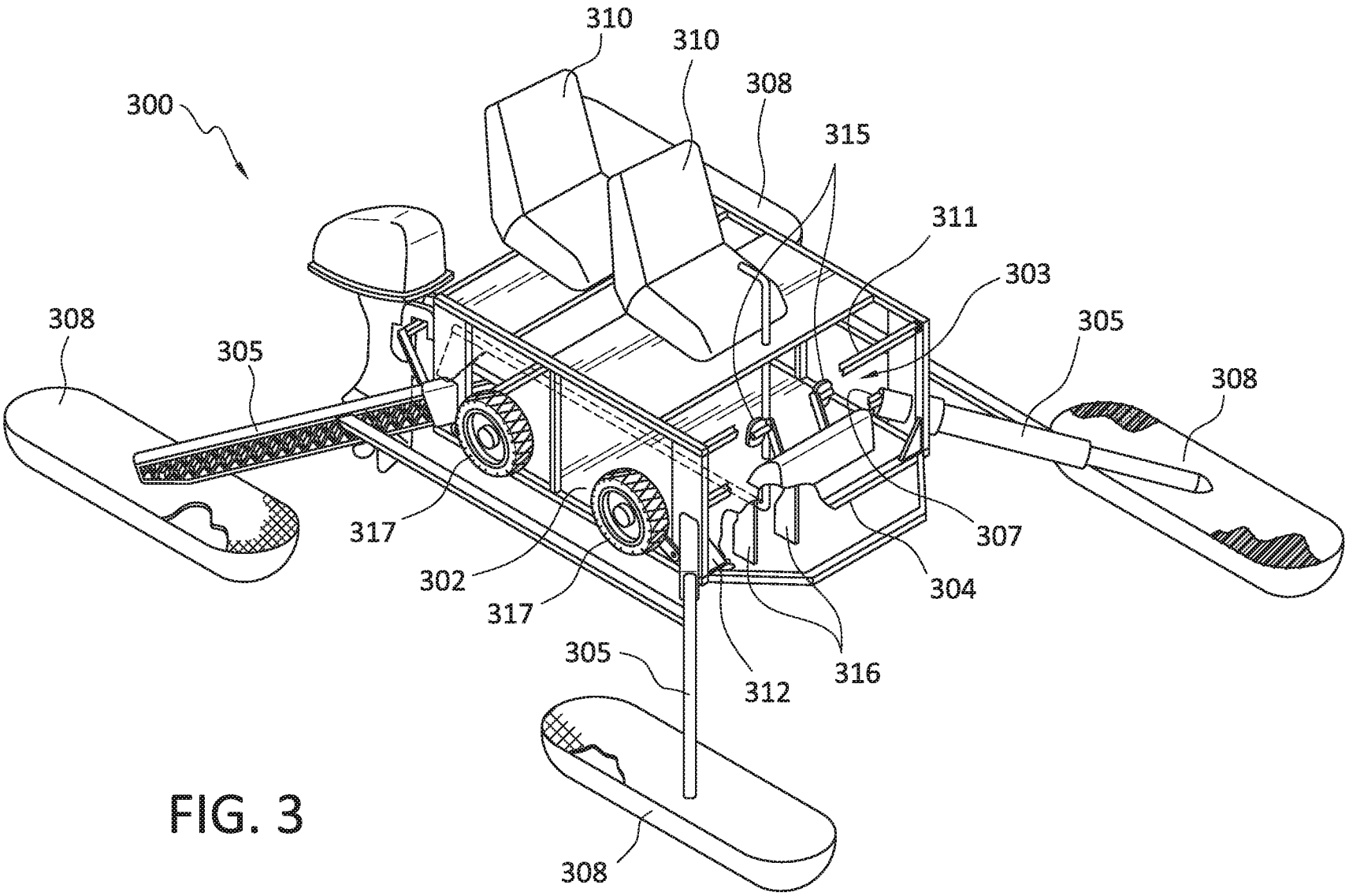

In another embodiment, the boat system 100 is equipped with a fin system 302 operable by a connected set of foot pedals 301 on the bridge. (FIG. 3). The fins 302 are positioned under the bridge 101 and extend into the water below the bridge. The pedals 301 are operably connected to the flippers by known mechanisms such that when an operator pushes on each pedal the fins move in a side-to-side motion, thereby propelling the boat 100. Such pedal drive systems are commonly employed on, for instance, kayaks, and the like and are commercially available. (See, Hobie Cat Company, Inc., Oceanside, Calif., US, Mirage kayak, etc.).

In another embodiment, the boat 100 is adapted to connect to the bridge 101 frame a motor. (FIG. 3). The motor is not in any way limited and includes, for instance, gas motors, propane motors, diesel motors, electric motors, and the like. Such motors are well known in the art and include lightweight trolling motors as well as other motors of the same class equipped with propellers. Optionally, the bridge 101 framework further comprises an extension at its base, as shown in FIG. 3, onto which such motors are mounted.

Other modes of propulsion are contemplated herein including recumbent bicycle-type paddle systems, paddle wheels, and human-powered propellers.

In another embodiment, the mode of propulsion supplied with the boat 100 comprises one or more sails. As shown, for instance, in FIG. 1, the described watercraft further comprises at least a fifth pontoon 109 attached via a fifth outrigger 105 to the bridge 101. Optionally, in a further embodiment, the fifth pontoon is instead attached to a third outrigger stiffener 118 that spans the gap between the front (fore) two pontoons. Attached to the fifth pontoon 109 is one or more sails 116. The sails are operable by the operator positioned on the bridge 101 in such a manner that they can be directed to catch wind in various directions. On the other hand, the sail 116, is in one embodiment positioned forward of the boat 100 between the two front pontoons 105 and resting on or stabilized by a further stiffener (not shown) positioned atop the two forward pontoons (not depicted). In such a configuration, one corner of sail 116 is attached to the stiffener, one corner is attached to the bridge bottom 104 and the final corner is attached to a vertical rod, or mast, used to raise the sail. The boat 100 is optionally equipped with as many as one, two, three, four, or more such sails positioned fore or aft of the bridge 101 in various combinations.

Contemplated herein are also optional seats 110 positioned on or in the bridge 101. The seats are of any known material that is resistant to water or sunlight damage and long-lasting in various weather conditions, such as polymer plastics, composites, wood with various protective coatings, and the like. Generally, such seats are at least 15 inches to about 17 inches wide or more. The one or more seats 110 are generally positioned in the middle, or middle rear, or middle forward, of the bridge 101. The one or more seats 110 are supported optionally by one or more cross members attached to the bridge 101 framework widthwise. Optionally, the seats pivot or otherwise rotate about an axis to allow the operator, when seated, to rotate from forward facing to aft facing, 360 degrees around. Said seats 110 are reversible attachable and when detached they are able to be stowed into the compartment 103 along with the other modular components of the boat system 100. Said one or more seats 110 are generally arranged in a front-to-back orientation with one seat being positioned in front of or behind the other. Contemplated herein are optionally as many as one, two, three, or even four seats positioned on the bridge 101. Optionally, also contemplated herein, are one or more foot brace blocks (not shown) mounted to the deck 102 positioned in front of each seat such that, for instance, while rowing, the operator braces the operator's legs and feet against the deck 102 while exerting pressure on the one or more oars 114.

Also contemplated herein, to aid in mobility and portability, are two or more wheels 117 and 217. (FIGS. 1 and 2). Generally, in one embodiment, it is contemplated that there are two wheels in the aft area of the deck 102 and optionally one or two wheels in the fore of the deck 102. The wheels are securely attached under the bridge 101 and under the deck 102. The wheels, in certain embodiments, are able to pivot and be positioned inside the bridge compartment 103 when not in use. In another embodiment, the wheels 117 and 217 are removable by a pin or other quick-release mechanism that allows them to be quickly and easily stowed inside the bridge compartment 103 when not in use. The wheel size, shape, and composition are not particularly limited but in certain embodiments comprise treads capable of maneuvering over sand and/or dirt trails, branches, tree roots, small rocks, and the like commonly encountered along the shoreline of rivers, oceans, lakes, creeks, and other waterways. In one embodiment the wheels are comprised of a solid material such as plastic, rubber, or other resin/polymer combination and optionally are inflatable.

In other embodiments the boat 100 is equipped with one or more straps securely attached to the bridge 101 framework to thereby allow the operator to carry the modular boat system by hand or on back, as in a backpack orientation, when disassembled and all components are securely stowed into the compartment 103. Optionally, the modular boat system further comprises one or more straps, ropes, chains, bungee cords, or other securing means by which the contents of the various components depicted in FIG. 2 are securely contained within the compartment 203. Such accouterments are also useful in pulling the disassembled modular boat system, towing it, attaching it to an automobile or other conveyance means, and the like.

In other embodiments, the bridge 101 of the modular boat system 100 further comprises one or more optional components, such as one or more lights, storage boxes, wet boxes, sun canopies, water-proof storage containers, storage bags, anchors, solar panels attached to the pontoons 108 or canopy and the like.

In one embodiment, the bridge further comprises one or more fins or rudders useful for steering the boat as depicted in FIG. 3.

Methods of Using the Boats

The described modular boat system is designed for ease of customization, ease of portability, and ease of use in multiple environments. The described modular boat system is capable of stable floatation and support of one or more operators on open water, in a lake, stream, river, pond, ocean, or any body of water large enough to fit the described boat. In another embodiment, it is contemplated that the described boat, especially or optionally equipped with one or more sails, is operable on frozen water, such as on a frozen lake. In this embodiment, its use is beneficial to the ice fisherman or other outdoor sports enthusiast wishing to sail or roll the modular boat across a solid surface, such as ice, sand, concrete, and the like.

The described modular boat system is easily portable and lightweight relative to other similar boats of its size, such as canoes, kayaks, and the like. The various elements or components of the modular boat system are quickly and easily removable and attachable by an operator working alone or in combination with one or more helpers. Thus, in a matter of minutes the entire modular boat system can be disassembled and packed into the compartment 103 for easy transport and mobility on land. An average adult operator is able to disassemble and pack away the modular boat system in as few as 5, 10, 15, 30, 45, or 60 minutes, depending on its size relative to the operator. In one embodiment, the watercraft is assembled in as few as 5 minutes by a single operator. Likewise, the described modular boat system is quick and easily unpacked from its compartment 103 and assembled as depicted in FIG. 1 in a similar amount of time by a single operator.

The described modular boat system provides unparalleled customization opportunities not commercially available anywhere else in the world. Thus, for instance, each of the pontoons 108 are swappable for any other pontoon of any other design, size, shape, or depth, etc. depending on the needs of the operator and/or the environment in which the boat is to be operated. For instance, in larger open water, or ocean, environments, larger pontoons may be desired for extra stability. Each pontoon comprises a common attachment mechanism with all other pontoons of the system thereby allowing them to be swapped in alternate configurations and allowing complete freedom of substitution of any of the pontoons of any size, shape, or design described herein. The same concept is true of any other component of the modular boat system described herein. Thus, even the outriggers, stiffeners, seats, sails, motors, etc. are individually customizable since each such element is bound by a common structural feature—that of being attachable or ability to be assembled into the described modular boat system by common attachment mechanisms securing each component to the boat structure. Thus, no matter the condition, environment, size of operator, number of operators, or needs for purpose, the described modular boat system is capable of being assembled into the necessary and/or desired configuration suited for the needs of the operator.

Thus, described herein are methods of floatation, i.e. methods of floating one or more operators on a body of water by way of the described modular boat system. Such methods include quick assembly of the modular boat components by way of quick release mechanisms of secure but reversible fastening mechanisms available in the art. Upon assembly of the various components, including the outriggers, pontoons, bridge, deck, and such other components as desired, the operator opens the front beam 111, enters the deck, optionally sits in the seat, closes the front beam 111, and embarks by way of any propulsion device desired or with which the boat is equipped.

Further modifications and alternative embodiments of various aspects of the methods and systems described herein will be apparent to those skilled in the art in view of this description. Accordingly, this description is to be construed as illustrative only and is for the purpose of teaching those skilled in the art the general manner of carrying out the disclosed methods and systems. It is to be understood that the forms of the disclosed methods and systems shown and described herein are to be taken as examples of embodiments. Elements and materials may be substituted for those illustrated and described herein, parts and processes may be reversed, and certain features of the disclosed methods and systems are capable of being utilized independently, all as would be apparent to one skilled in the art after having the benefit of this description of the disclosed methods and systems. Changes may be made in the elements described herein without departing from the spirit and scope of the disclosed methods and systems as described in the following claims.

All of the references cited above, as well as all references cited herein, are incorporated herein by reference in their entireties. The following examples are offered by way of illustration and not by way of limitation.

The breadth and scope of the present disclosure should not be limited by any of the above-described exemplary embodiments, but should be defined only in accordance with the following claims and their equivalents. That is, the above examples are included to demonstrate various exemplary embodiments of the described methods and systems. It will be appreciated by those of skill in the art that the techniques disclosed in the examples represent techniques discovered by the inventor to function well in the practice of the described methods and systems, and thus can be considered to constitute optional or exemplary modes for its practice. However, those of skill in the art will, in light of the present disclosure, appreciate that many changes can be made in these specific embodiments that are disclosed and still obtain a like or similar result without departing from the spirit and scope of the described methods and systems.

What is claimed is:

1. A modular boat system, comprising:

(i) at least four pontoons each comprising a top side and a hull, (ii) at least four outriggers, wherein each outrigger is reversibly attachable at one end to the top side each of the at least four pontoons, (iii) a bridge that is reversibly attachable to an opposite end of each of the at least four outriggers and comprises a compartment and a deck, wherein the deck is at least 2 foot by 4 foot in size, wherein the deck is on a bottom side of the bridge and the compartment is above the deck and within the bridge, (iv) at least two outrigger stiffeners, wherein each outrigger stiffener is attached to at least one outrigger, with an opposite end of each outrigger stiffener attached either to the bridge or to another outrigger stiffener, and wherein each outrigger stiffener is optionally collapsible, and (v) one or more of the following:

a fifth pontoon reversibly attachable to the bridge via a further outrigger and/or attached to a third outrigger stiffener attached to one or more of the at least four pontoons, and a sail operably attached: (a) to the fifth pontoon, or (b) the third outrigger stiffener, or at least two oars, wherein the at least two oars each comprise a paddle on one end and a handle on another end able to accommodate a human hand, wherein the at least two oars lock into one or more oar attachment sites such that the paddle is capable of touching water when the modular boat system is assembled and on water and the handle end extends to the bridge and is operable by an operator positioned on the deck, wherein the one or more oar attachment sites are securely fastened to the bridge and/or one or more of the at least four outriggers and/or one or more of the at least two outrigger stiffeners.

2. The modular boat system of claim 1, wherein when the modular boat system is assembled as the boat:

(a) each of the at least four pontoons are attached to and positioned below the at least four outriggers that extend diagonally downward from the bridge to each of the at least four pontoons, (b) the bridge is attached to the at least four outriggers such that the bridge is above the at least four outriggers and above the at least four when the modular boat is placed on water, and (c) the at least two outrigger stiffeners are attached to at least two outriggers and extend from fore to aft each on one side of the bridge, thereby providing stabilization, and wherein the modular boat system is capable of being rowed by an operator positioned on the deck of the bridge.

3. The modular boat system of claim 1, wherein when the modular boat system is disassembled:

(d) the at least four pontoons, the at least four outriggers, and the at least two outrigger stiffeners fit within the compartment inside the bridge, and (e) all modular boat system components also fit within the compartment of the bridge.

4. The modular boat system of claim 1, wherein one or more wheels are attached to the bridge such that when the modular boat system is disassembled the modular boat system is conveyable on the one or more wheels along a ground surface.

5. The modular boat system of claim 1, wherein the boat is no more than 16 foot, 12 foot, 10 foot, 8 foot, or 6 foot in length.

6. The modular boat system of claim 1, wherein the deck is rectangular in shape and is at least two foot by four foot in size.

7. The modular boat system of claim 1, further comprising a propulsion system, wherein the propulsion system comprises oars, a motor, sail, and/or a pedal system optionally including one or more fins and/or propellers connected thereto.

8. The modular boat system of claim 7, wherein the propulsion system is reversibly attachable to the bridge.

9. The modular boat system of claim 1, wherein the bridge further comprises at least two backpack straps reversibly fastened to an underside surface of the bridge, wherein the backpack straps are optionally adjustable.

10. The modular boat system of claim 1, further comprising one or more rudders reversibly attached to an underside surface of the bridge by way of a rudder beam attached to the bridge, wherein the rudder beam extends, when assembled, into water with the rudder being in water, and wherein the rudder beam extends to the topmost side of the bridge and comprises a handhold positioned on the deck for steering the boat by an operator.

11. The modular boat system of claim 1, wherein the modular boat system comprises at least two oars, and wherein one or more of the at least two oars are locked into the one or more oar attachment sites by a pin, an oarlock, a bolt, or a clip.

12. The modular boat system of claim 1, wherein the bridge comprises one or more adapters into which the one or more outriggers are inserted when the modular boat system is assembled.

13. The modular boat system of claim 1, wherein the four or more pontoons are in the shape of an oval, a diamond, a quadrilateral, a triangle, cylinder, a tube, a torpedo, or a surfboard.

14. The modular boat system of claim 1, further comprising at least one seat reversibly attachable to the deck or bridge, wherein optionally the seat is rotatable about an axis.

15. The modular boat system of claim 11, wherein the at least two oars are telescoping oars, collapsible oars, hinged oars, or are comprised of at least two pieces that assemble into a single oar.

16. The modular boat system of claim 1, wherein the at least four outriggers and/or at least two outrigger stiffeners are comprised of wood, metal, metal alloy, a composite material, carbon fiber, or a combination thereof.

17. The modular boat system of claim 1, wherein the bridge is comprised of wood, metal, metal alloy, a composite material, carbon fiber, or a combination thereof.

18. The modular boat system of claim 1, wherein the at least four pontoons are comprised of wood, metal, metal alloy, a composite material, carbon fiber, fabric, cloth, plastic, optionally injection molded plastic, or a combination thereof.

* * * * *